US010597985B2

(12) United States Patent
Peterson et al.

(10) Patent No.: US 10,597,985 B2
(45) Date of Patent: Mar. 24, 2020

(54) APPARATUS AND METHOD FOR INSTALLING TRACER MATERIAL IN DOWNHOLE SCREENS

(71) Applicants: Elmer Peterson, Porter, TX (US); Christophe Malbrel, Houston, TX (US)

(72) Inventors: Elmer Peterson, Porter, TX (US); Christophe Malbrel, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 68 days.

(21) Appl. No.: 15/480,720

(22) Filed: Apr. 6, 2017

(65) Prior Publication Data

US 2018/0291714 A1 Oct. 11, 2018

(51) Int. Cl.
*E21B 43/08* (2006.01)
*E21B 47/10* (2012.01)

(52) U.S. Cl.
CPC ..... *E21B 43/084* (2013.01); *E21B 47/1015* (2013.01)

(58) Field of Classification Search
CPC ..... E21B 43/084; E21B 47/1015
USPC ..... 166/378
See application file for complete search history.

(56) References Cited

U.S. PATENT DOCUMENTS 5,394,938 A 3/1995 Cornette et al.
5,664,628 A * 9/1997 Koehler ..... B01D 29/111 166/228
8,567,497 B2 10/2013 Moen et al.
2011/0024111 A1* 2/2011 Moen ..... E21B 43/08 166/278
2014/0014373 A1* 1/2014 Richards ..... E21B 17/026 166/385
2015/0060059 A1 3/2015 Langlais et al.
(Continued)

FOREIGN PATENT DOCUMENTS

WO 2011153636 A1 12/2011

OTHER PUBLICATIONS

Notification of Transmittal of the International Search Report and the Written Opinion of the International Searching Authority, or the Declaration; PCT/US2018/021097; dated Jun. 26, 2018: 11 pages.

*Primary Examiner* — Taras P Bemko
(74) *Attorney, Agent, or Firm* — Cantor Colburn LLP

(57) ABSTRACT

A sand screen assembly including a base pipe, a filtration subassembly disposed about the base pipe, the filtration assembly being removable and replaceable on the base pipe as a subassembly, a hollow defined between the filtration subassembly and the base pipe, a removable and replaceable end cap securable to the base pipe with a fastener and configured to retain the filtration subassembly on the base pipe. A method for installing a tracer material in a sand screen assembly. A downhole system including a base pipe, a filtration subassembly disposed about the base pipe, the filtration assembly being removable and replaceable on the base pipe as a subassembly, a hollow defined between the filtration subassembly and the base pipe, a removable and replaceable end cap securable to the base pipe with a fastener and configured to retain the filtration subassembly on the base pipe.

16 Claims, 4 Drawing Sheets

(56) References Cited

U.S. PATENT DOCUMENTS

| | | | | |
|---|---|---|---|---|
| 2015/0192008 | A1* | 7/2015 | Dikshit | E21B 47/1015 166/250.12 |
| 2015/0308239 | A1 | 10/2015 | Langlais et al. | |
| 2015/0375144 | A1* | 12/2015 | Greci | E21B 43/08 29/896.61 |
| 2016/0281475 | A1 | 9/2016 | Cunningham et al. | |
| 2018/0347322 | A1 | 12/2018 | Osunjaye et al. | |

* cited by examiner

APPARATUS AND METHOD FOR INSTALLING TRACER MATERIAL IN DOWNHOLE SCREENS

BACKGROUND

In the drilling and completion industry, Screens have long been used to filter sand particles entrained in fluids recovered from resource bearing subsurface formations. More recently, it has been determined that the use of tracers installed in boreholes to identify from where certain fluids emanate is beneficial to operators for the purpose of making operational decisions for wells. In some cases, the tracer materials are disposed in sand screens at a factory location when the sand screen is manufactured while in other cases, screens have been supplied with a port at an end thereof through which tracer may be deposited in the sand screen assembly at a site of use before being run in the hole. While these methods are somewhat effective, they lack efficiency or maximal effectiveness because it is not known what type of tracer material or how much of it will be needed in a particular sand screen assembly at the manufacturing stage and for those configurations allowing the deposition of some tracer material through ports, the application is limited. Hence the art would well appreciate alternatives that alleviate these drawbacks.

SUMMARY

A sand screen assembly including a base pipe, a filtration subassembly disposed about the base pipe, the filtration assembly being removable and replaceable on the base pipe as a subassembly, a hollow defined between the filtration subassembly and the basepipe, a removable and replaceable end cap securable to the base pipe with a fastener and configured to retain the filtration subassembly on the base pipe.

A method for installing a tracer material in a sand screen assembly at point of use including unsecuring an end cap of a sand screen assembly as as in any prior embodiment, removing the end cap from the base pipe, removing the filtration subassembly of the sand screen assembly from the base pipe, disposing a tracer material block on the base pipe, replacing the filtration subassembly on the base pipe over the tracer material block, and replacing and resecuring the end cap.

A downhole system including a base pipe, a filtration subassembly disposed about the base pipe, the filtration assembly being removable and replaceable on the base pipe as a subassembly, a hollow defined between the filtration subassembly and the basepipe, a removable and replaceable end cap securable to the base pipe with a fastener and configured to retain the filtration subassembly on the base pipe.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
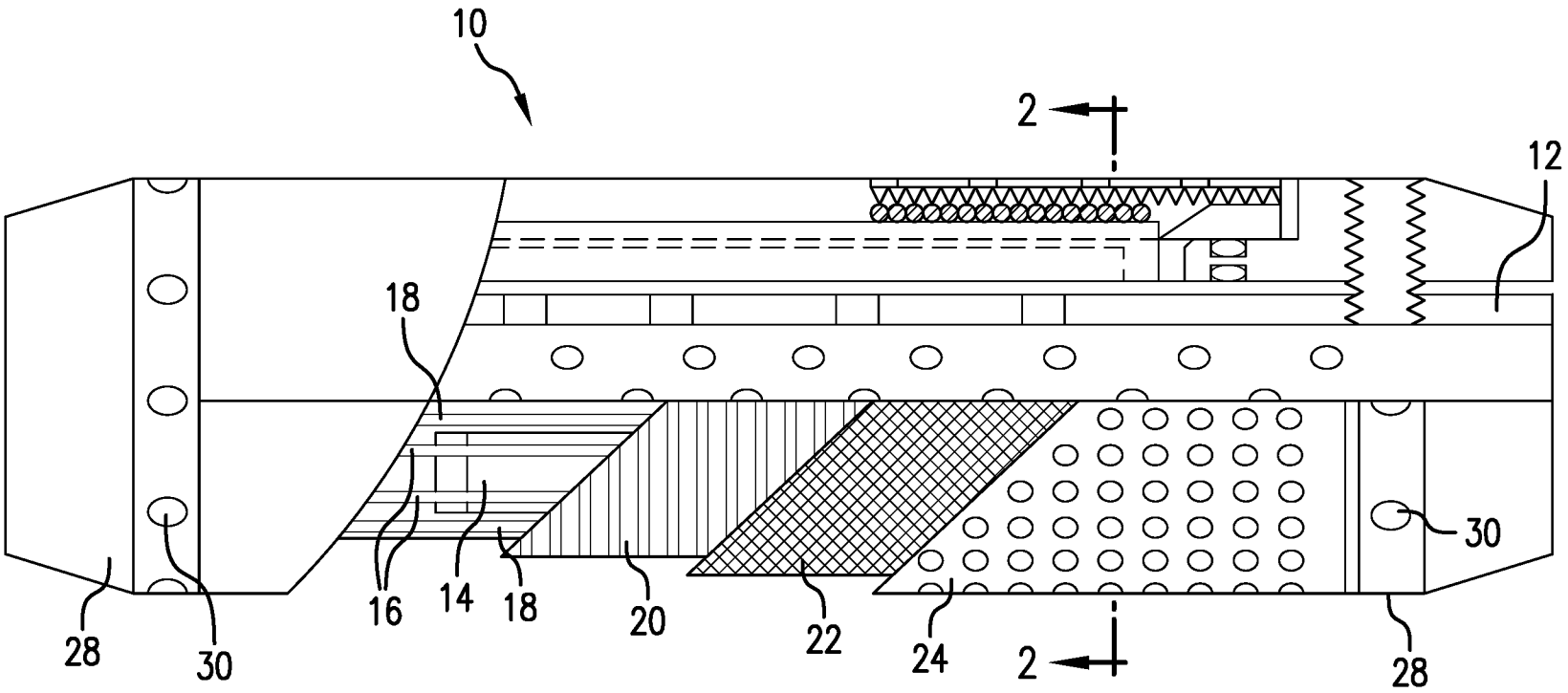
FIG. 1 is a three-quarter sectional partially broken away view of a sand screen assembly as disclosed herein.
Figure 1A:
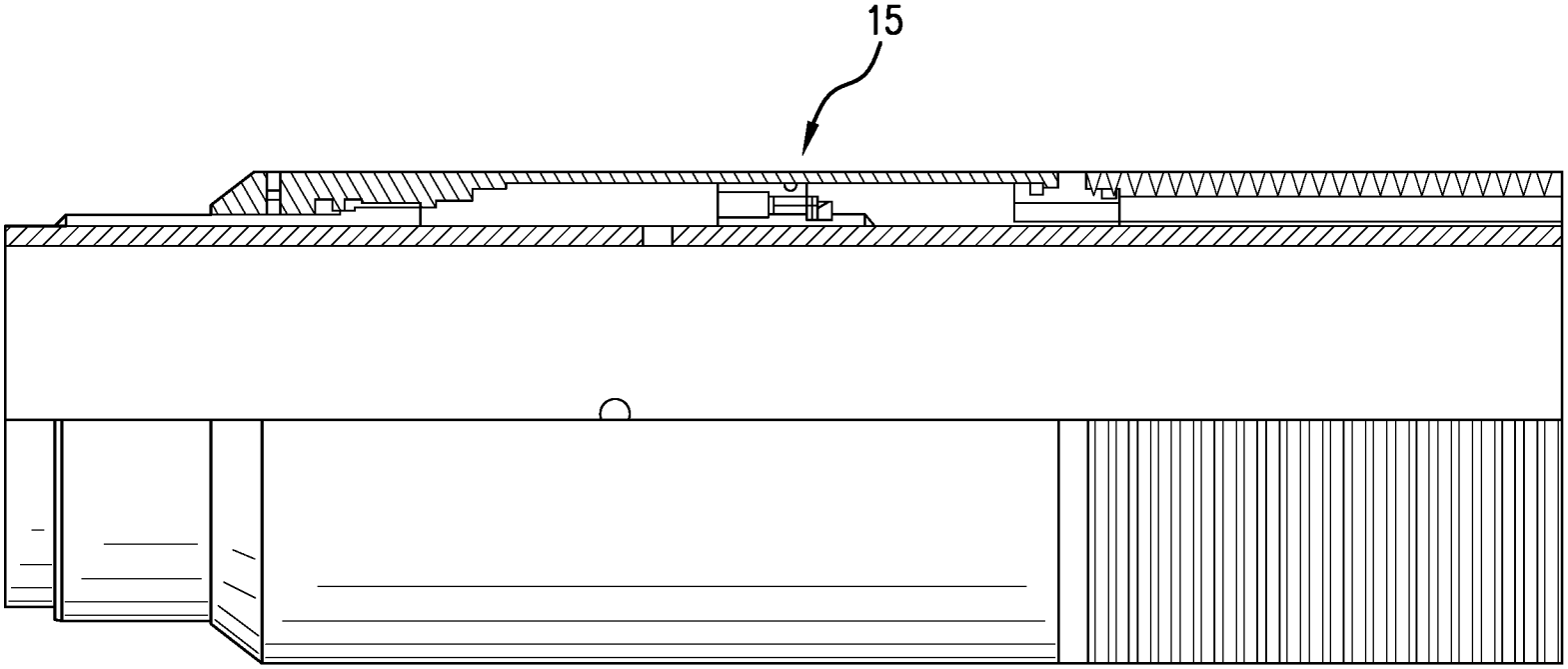
FIG. 1*a* is a schematic view of an arrangement similar to FIG. 1 to illustrate an MTV and/or ICD arrangement.

Referring to FIG. 1, a sand screen assembly 10 is illustrated that is configured for point of use tracer installation. The assembly 10 includes a base pipe 12 having a tracer material block 14 disposed thereon. It is to be understood that the base pipe 12 may be a holed base pipe as is illustrated in FIG. 1 so that fluids in an inbound direction proceed radially inwardly to a string in which the assembly is a part or the base pipe may be a blank base pipe with a fluid flow arrangement to one or both ends of the sand screen assembly 10 where fluids travel in an inbound direction until interacting with the base pipe and then travel longitudinally to a valve such as a multitasking valve commercially available from Baker Hughes Incorporated and/or an inflow control device 15 (see FIG. 1*a*) before proceeding radially inwardly into a string of which the assembly 10 is a part. The term "block" is used for convenience purposes only and does not necessarily convey a rectilinear shape. Any shape of the material that is useful for a particular iteration is contemplated such that the term "blob" might also be appropriately used. Radially outwardly of the tracer material block 14 are short ribs 16 and disposed adjacent tracer material block 14 are tall ribs 18. Both types of ribs and their related function are discussed hereunder with reference to FIG. 2. Radially outwardly of the ribs 16 and 18 is a drainage layer 20 which may be of a wrapped wire variety. Following the drainage layer 20 is a mesh layer 22 and finally a protective shroud 24 radially outwardly of the other layers. These components together are referred to herein as the filtration subassembly 26. It is important to note that the filtration subassembly as described is constructed as such because of the illustration of FIG. 1 but that this only represents one configuration of the filtration subassembly. It is to be understood that the filtration subassembly may also consist of the short (and some embodiments having the tall) ribs with only a wire wrap, or with only a shroud, or with only some other filtering media and that the filtration subassembly may also be configured with any combination of the foregoing layers of material. The filtration assembly 26 once created is configured to be removable and replaceable on the base pipe 12 to access the base pipe surface. Removal and replacement is in an embodiment by sliding the filtration subassembly 26 off the base pipe from an end thereof.

In embodiments hereof, the configuration of the ribs 16 and 18 of the filtration subassembly 26 is quite unique as is the end cap 28 with fasteners 30 on one or both longitudinal ends of the sand screen assembly 10. These features work together to facilitate rapid point of use installation of tracer material in quantities not heretofore possible and at speeds unmatched in the prior art.

It is to be understood that the end cap 28 is of a removable and replaceable configuration and retained in place by the fastener(s) 30. By removing one cap 28 or both of the caps 28, the entire filtration subassembly 26 (as noted above comprising the ribs 16 and 18, the drainage layer 20, the mesh layer 22 and the shroud 24) is easily removable in one piece by a workman by sliding the same off one end of the base pipe 12, thereby giving the workman access to the surface of the base pipe 12 in order to secure a selected volume and type of tracer material to the surface of the base pipe 12.

Specifically, by simply removing the entire filtration subassembly, the base pipe 12 is exposed and tracer material block 14 may be placed thereon and secured thereto by selected means. Securement may be by adhesive means or mechanical means as desired. In an embodiment an epoxy material is used to secure the tracer material block 14 to the base pipe 12.

Figure 2:
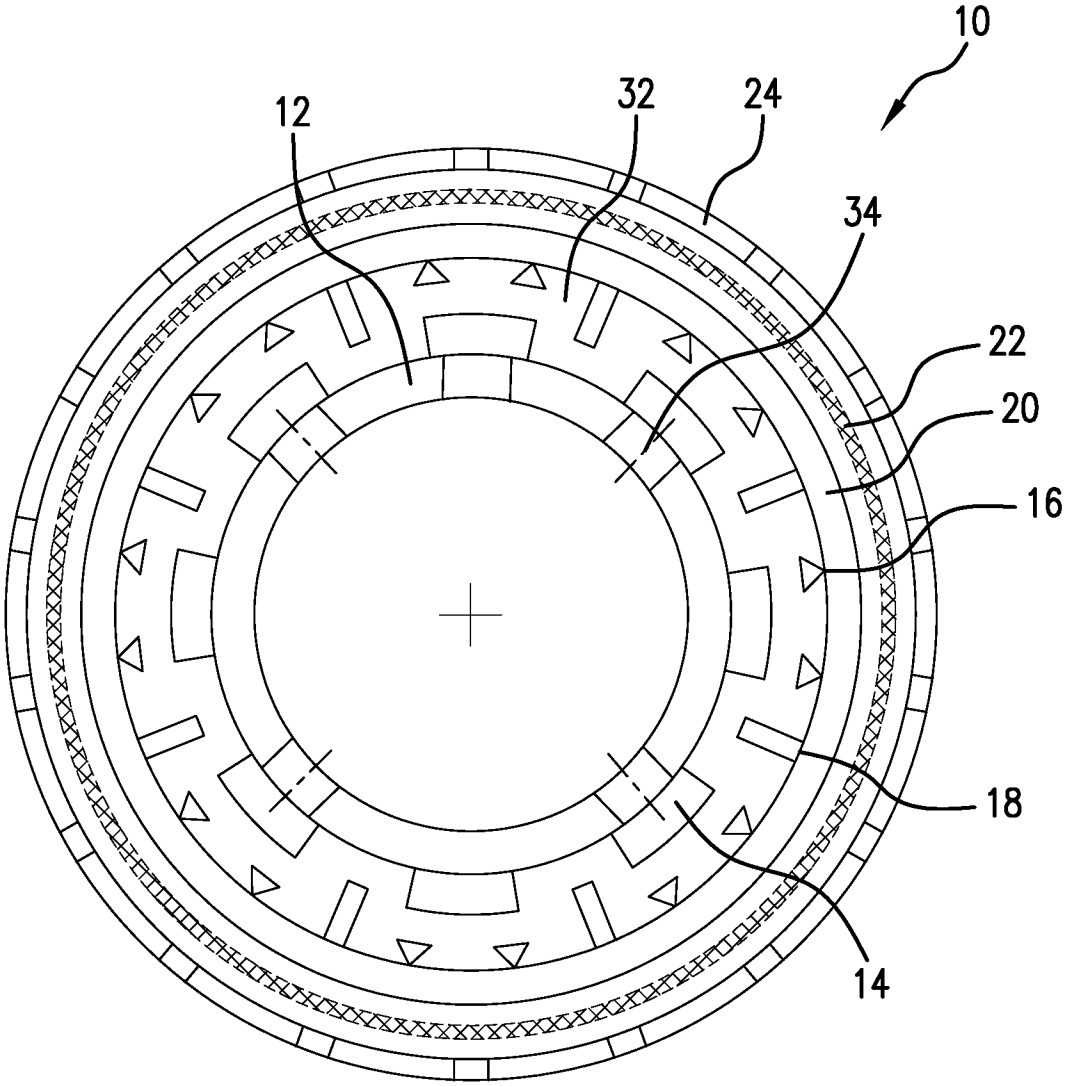
FIG. 2 is a cross sectional view of the embodiment of FIG. 1 taken along section line 2-2.

Referring to FIG. 2, a cross sectional view will provide additional understanding of the function of the short 16 and tall 18 ribs as well as an understanding of the positioning of the tracer material block 14. In this view, it can be appreciated that the tall ribs 18 span a radial distance between the base pipe 12 and the drainage layer 20 thereby supporting the rest of the filtration subassembly 26. It is to be understood that although the FIG. 2 iteration illustrated the tall ribs 18 secured to the drainage layer 20 and slidable on the base pipe 12, this could be reversed with the tall ribs 18 secured to the base pipe 12 and the drainage layer 20 be slidable over the tall ribs 18. In either iteration, the tall ribs will when the sand screen assembly is assembled span a radial distance between the drainage layer 20 and the base pipe 12 to provide radial support for the filtration subassembly 26. The short ribs 16 are employed to provide some support for the drainage layer 20 for construction thereof but to also leave room radially between an innermost extent of the short ribs 16 and the base pipe 12 to effectively create hollows 32, bounded adjacently by tall ribs 18, for the placement of tracer material block 14. The short ribs 16 then should have a radial dimension as small as is practical to support the drainage layer during manufacture and leave as large a radial dimension as possible for the hollow. The hollows 32 provide a significant volume for tracer material block 14 that in length anywhere from a short distance to the entire length of the screen filtration subassembly 26. This allows an operator to ensure there is enough tracer material 14 for a long interval of release or a large release as dictated by the type and erosion rate of the tracer material block 14 selected. It is to be appreciated that the tracer material should be located to substantially avoid occlusion of holes 34 in the base pipe 12 so that drainage of fluid to the base pipe 12 is substantially unencumbered. It is also to be appreciated that the tracer material block 14 is to be secured to the base pipe 12 in circumferentially spaced manner so that the tall ribs 18 may slide back over the base pipe 12 upon reassembly after securement of the tracer material without impediment occasioned by the tracer material block 14 itself. This arrangement is easily apprehended in FIG. 2.

With respect to the tracer material block 14, it should be appreciated that the same material may be used for each block, different material for each block of tracer material or several blocks of tracer material can be the same while others differ. It is also contemplated that as few as one block of tracer material block 14 may be employed in a sand screen assembly to as many as can be accommodated as dictated by the number of hollows 32 in a particular sand screen assembly 10.

Figure 3:
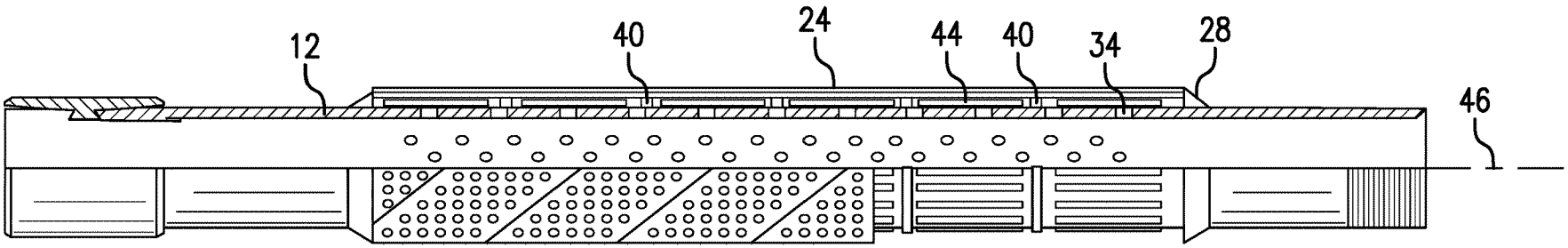
FIG. 3 is a three-quarter sectional view of an alternate embodiment of a sand screen assembly as disclosed herein.

In another embodiment, referring to FIG. 3, tall ribs 18 from the previous embodiment are dispensed with. Without the radial support provided by the tall ribs 18, other structure to provide that support is provided in the form of annular rings 40 are provided. The rings 40 are secured to the base pipe 12 since once tracer material 44 is secured to the base pipe 12 in this embodiment, the rings 40 would interfere with the tracer material 44 if they were secured to the filtration subassembly 26 as were the tall ribs in an iteration of the previous embodiment. This will be appreciated in FIG. 3 since the rings 40 and the tracer material 44 occupy the same annular distance from the sand screen assembly axis 46 such that longitudinal sliding of one past the other would be impossible. The length of each tracer material block 14 is dictated by the distance between adjacent rings 40. Again, substantial volume of tracer material block 14 is made possible by the embodiment and the options of single material or multiple materials in blocks is contemplated.

As in the previous embodiment, the tracer material block 14 is to be secured to the base pipe 12 in positions substantially avoiding occlusion of the base pipe holes 34.

Set forth below are some embodiments of the foregoing disclosure:

Embodiment 1

A sand screen assembly including a base pipe, a filtration subassembly disposed about the base pipe, the filtration assembly being removable and replaceable on the base pipe as a subassembly, a hollow defined between the filtration subassembly and the base pipe, a removable and replaceable end cap securable to the base pipe with a fastener and configured to retain the filtration subassembly on the base pipe.

Embodiment 2

The sand screen assembly as in any prior embodiment wherein the filtration assembly includes tall ribs and short ribs interspersed with one another to form the hollow.

Embodiment 3

The sand screen assembly as in any prior embodiment wherein the tall ribs are secured to the filtration subassembly and slide on the base pipe.

Embodiment 4

The sand screen assembly as in any prior embodiment wherein the tall ribs slide on the filtration subassembly and are secured to the base pipe.

Embodiment 5

The sand screen assembly as in any prior embodiment further comprising a tracer material block disposed in the hollow.

Embodiment 6

The sand screen assembly as in any prior embodiment wherein the tracer material block is adhered to the base pipe.

Embodiment 7

The sand screen assembly as in any prior embodiment further comprising a plurality of tracer materials in a plurality of tracer material blocks in a plurality of hollows.

Embodiment 8

The sand screen assembly as in any prior embodiment wherein the plurality of tracer materials are the same material.

Embodiment 9

The sand screen assembly as in any prior embodiment wherein the plurality of tracer materials are of different materials.

Embodiment 10

The sand screen assembly as in any prior embodiment wherein the sand screen assembly further includes rings disposed between the filtration subassembly and the base pipe to provide radial support to the filtration subassembly.

Embodiment 11

The sand screen assembly as in any prior embodiment wherein the hollow is defined between adjacent rings.

Embodiment 12

The sand screen assembly as in any prior embodiment wherein the rings are secured to the base pipe.

Embodiment 13

The sand screen assembly as in any prior embodiment further comprising one or more of a valve and an inflow control device in fluid communication with the filtration subassembly.

Embodiment 14

A method for installing a tracer material in a sand screen assembly at point of use including unsecuring an end cap of a sand screen assembly as as in any prior embodiment, removing the end cap from the base pipe, removing the filtration subassembly of the sand screen assembly from the base pipe, disposing a tracer material block on the base pipe, replacing the filtration subassembly on the base pipe over the tracer material block, and replacing and resecuring the end cap.

Embodiment 15

The method as in any prior embodiment wherein the removing the filtration subassembly is by sliding.

Embodiment 16

The method as in any prior embodiment wherein the disposing the tracer material block further includes adhering the tracer material block to the base pipe.

Embodiment 17

The method as in any prior embodiment wherein the disposing is disposing multiple tracer material blocks in hollows of the sand screen assembly.

Embodiment 18

A downhole system including a base pipe, a filtration subassembly disposed about the base pipe, the filtration assembly being removable and replaceable on the base pipe as a subassembly, a hollow defined between the filtration subassembly and the base pipe, a removable and replaceable end cap securable to the base pipe with a fastener and configured to retain the filtration subassembly on the base pipe.

Embodiment 19

The system as in any prior embodiment further comprising one or more of a valve and an inflow control device in fluid communication with the filtration subassembly.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A sand screen assembly comprising:

a base pipe;

a filtration subassembly disposed about the base pipe, the filtration assembly being removable and replaceable on the base pipe as a subassembly and including tall ribs and short ribs extending radially inwardly from a filtration material interspersed with one another, the tall ribs being secured to the filtration material and slide on the base pipe;

a hollow defined radially between the filtration subassembly, the tall and short ribs and the base pipe, the hollow dimensioned and positioned to receive a block of tracer material;

a removable and replaceable end cap securable to the base pipe with a fastener and configured to retain the filtration subassembly on the base pipe.

2. The sand screen assembly as claimed in claim 1 further comprising a tracer material block disposed in the hollow.

3. The sand screen assembly as claimed in claim 2 wherein the tracer material block is adhered to the base pipe.

4. The sand screen assembly as claimed in claim 1 further comprising a plurality of tracer materials in a plurality of tracer material blocks in a plurality of hollows.

5. The sand screen assembly as claimed in claim 4 wherein the plurality of tracer materials are the same material.

6. The sand screen assembly as claimed in claim 4 wherein the plurality of tracer materials are of different materials.

7. The sand screen assembly as claimed in claim 1 wherein the sand screen assembly further includes rings disposed between the filtration subassembly and the base pipe to provide radial support to the filtration subassembly.

8. The sand screen assembly as claimed in claim 7 wherein the hollow is defined between adjacent rings.

9. The sand screen assembly as claimed in claim 7 wherein the rings are secured to the base pipe.

10. The sand screen assembly as claimed in claim 1 further comprising one or more of a valve and an inflow control device in fluid communication with the filtration subassembly.

11. A method for installing a tracer material in a sand screen assembly at point of use comprising:

unsecuring an end cap of a sand screen assembly as claimed in claim 1;

removing the end cap from the base pipe;

removing, by sliding, the filtration subassembly of the sand screen assembly from the base pipe;

disposing a tracer material block on the base pipe;

replacing the filtration subassembly on the base pipe over the tracer material block; and replacing and resecuring the end cap.

12. The method as claimed in claim 11 wherein the disposing the tracer material block further includes adhering the tracer material block to the base pipe.

13. The method as claimed in claim 11 wherein the disposing is disposing multiple tracer material blocks in hollows of the sand screen assembly.

14. A sand screen assembly comprising:

a base pipe;

a filtration subassembly disposed about the base pipe, the filtration assembly being removable and replaceable on the base pipe as a subassembly and including tall ribs and short ribs extending radially inwardly from a filtration material interspersed with one another, the tall ribs being slidable on the filtration material and secured to the base pipe;

a hollow defined radially between the filtration subassembly, the tall and short ribs and the base pipe, the hollow dimensioned and positioned to receive a block of tracer material;

a removable and replaceable end cap securable to the base pipe with a fastener and configured to retain the filtration subassembly on the base pipe.

15. A downhole system including:

a base pipe;

a filtration subassembly disposed about the base pipe, the filtration assembly being removable and replaceable on the base pipe as a subassembly and including tall ribs and short ribs extending radially inwardly from a filtration material interspersed with one another, the tall ribs being secured to the filtration material and slide on the base pipe;

a hollow defined radially between the filtration subassembly, the tall and short ribs and the base pipe, the hollow dimensioned and positioned to receive a block of tracer material;

a removable and replaceable end cap securable to the base pipe with a fastener and configured to retain the filtration subassembly on the base pipe.

16. The system as claimed in claim 15 further comprising one or more of a valve and an inflow control device in fluid communication with the filtration subassembly.

* * * * *